United States Patent [19]

Yokoi

[11] Patent Number: 4,631,809

[45] Date of Patent: Dec. 30, 1986

[54] PROCESS FOR MANUFACTURE CORES OF ELECTROMAGNET

[75] Inventor: Toshiro Yokoi, Nagoya, Japan

[73] Assignee: Sanmeidenki Kabushikikaisha, Japan

[21] Appl. No.: 597,872

[22] Filed: Apr. 9, 1984

[30] Foreign Application Priority Data

Jul. 4, 1983 [JP] Japan ..... 58-121456
Oct. 17, 1983 [JP] Japan ..... 58-193846

[51] Int. Cl.[4] ..... H01F 7/06

[52] U.S. Cl. ..... 29/607; 29/609; 228/135; 228/179

[58] Field of Search ..... 29/597, 607, 609; 336/234; 335/281; 228/178, 179, 135, 138

[56] References Cited

U.S. PATENT DOCUMENTS 1,354,007 9/1920 Van Dusen ..... 29/597
1,424,954 8/1922 Van Dusen ..... 29/597
2,251,326 8/1941 Cullin ..... 29/597
2,455,560 12/1948 Cobb et al. ..... 29/597
2,618,844 11/1952 Wright et al. ..... 29/609
3,161,947 12/1964 Schäfer et al. ..... 29/597
3,293,694 12/1966 Taylor, Jr. ..... 29/597
3,720,998 3/1973 Malm et al. ..... 29/597

*Primary Examiner*—Mark Rosenbaum
*Assistant Examiner*—P. W. Echols
*Attorney, Agent, or Firm*—William A. Drucker

[57] ABSTRACT

A process for manufacturing a core used for an electromagnet is disclosed. First, one connecting structure and a number of core elements having sides of the same shape are prepared. Next, a number of core elements are radially disposed round and about the connecting portion. In this case, an engaging portion provided on each of core elements is brought into engagement with a connecting portion provided on the connecting structure whereby the core elements are positioned relative to the connecting structure. Next, the connecting structure and a number of core elements are integrally connected. Thereby a core is finished.

6 Claims, 21 Drawing Figures

PROCESS FOR MANUFACTURE CORES OF ELECTROMAGNET

BACKGROUND OF THE INVENTION

1. Field of the Invention

This invention relates to an electromagnet wherein a cylindrical fixed core and a cylindrical movable core are accommodated inside a tubular coil and the movable core is shifted towards and attracted to the fixed core under a magnetic force exerted between both cores due to a magnetic flux produced through each of the cores by energizing the coil and more particularly to a process for manufacturing a magnetic core constitution used as a fixed core, a movable core or the like.

2. Prior Art

An electromagnet of this type is disclosed, for example, in U.S. Pat. No. 3,633,139. If the core is formed of a solid material, high eddy current is generated when current flows through the coil to impart the magnetic flux to the core. This gives rise to a problem in that a great heat generation occurs. A further problem occurs wherein electric power applied to the coil is wastefully consumed for said heat generation. In view of the foregoing, as cores free from these problems as noted above, a core having a number of core elements, which are formed from thin steel sheet, laminated has been extensively used. However, it takes time and labor to make these cores. That is, as shown in FIG. 20, plural sheets of core elements 111, 112 and 113, which are different in side shape from one another, are prepared. Next, these elements are superposed one upon another in a way that order and the number of sheets are correct. Then, these core elements are connected together by means of self-locking pins 114 while holding them inseparably. Subsequently, the thus connected elements are cut by a machine tool such as a lathe into the required shape as shown by the dash-dotted contour lines at 115. Many steps as mentioned above are necessary.

In addition, the core fabricated as described above has its core elements which are variously different in shape and dimension. Thus, when shocks are applied during the use of the electromagnet, forces received by each of these elements are different from one another. Therefore, while the aforesaid shocks are being repeatedly applied, the core elements are displaced one another with the result that the core becomes deformed.

SUMMARY OF THE INVENTION

It is therefore a first object of the present invention to provide a process to manufacture a magnetic core construction which consists of an inner solid portion around its axis and an outer laminated portion adapted on the inner portion and defining the outer circumferential surface of the core.

The area of the cross-section, perpendicular to the axis, of the inner portion is made smaller. Accordingly, the eddy current induced in the inner portion is very small despite the solid constitution of the inner portion. On the other hand, the corresponding area of the cross-section of the outer portion is larger. However, eddy current is hard to be induced in the outer portion since this portion is a laminated constitution made of a plurality of core elements arranged radially and moreover adjacent ones of the core elements are electrically insulated from each other.

Therefore, according to the manufacturing process of the present invention, a magnetic core can consequently be produced in which generations of eddy current is highly suppressed. Such a magnetic core can provide a large attracting force with a comparatively small exciting current since only a small amount of electric power is dissipated in the magnetic core as Joule's heat due to eddy current.

A second object of the present invention is to provide a manufacturing process by which a magnetic core with the aforementioned outer portion can easily be made into a cylindrical external form despite the laminated constitution of the outer portion.

Namely in the manufacturing process according to the present invention, each of core elements of a uniform thickness and each of wedge-shaped core elements, whose thickness is increasing from its inner to outer edges are alternately arranged radially around a connecting means as shown in FIGS. 3 and 12. Thus, a magnetic core of a circular cylindrical external shape is naturally formed by this alternate arrangement of two types of core elements. A machining work on a wide side surface as required for a prior magnetic core of laminated construction can be dispensed with.

A third object of the present invention is to provide a magnetic core manufacturing process in which commercially available silicon steel strips of a uniform thickness can be utilized as a material for a core element with adjacent core elements being electrically insulated mutually for prevention of generation of eddy current. The object is further to provide a magnetic core manufacturing process by which the wedge-shaped core elements for facilitating the radial alignment of many core elements can simply be prepared.

That is, in the process according to the present invention, the core elements of the uniform thickness are made of strips of silicon steel and the wedge-shaped core elements are made of ordinary magnetic steel sheets, so that usual silicon steel strips available commercially can thus be utilized as the material for the core elements of silicon steel sheets. The ordinary magnetic steel sheets are easier to process than silicon steel sheets and can easily be stamped out into wedge-shaped core elements by a small-scale press.

A fourth object of the present invention is to provide a magnetic core manufacturing process by which each of core elements made of ordinary magnetic steel sheets can be used as an element of a magnetic core in a state electrically insulated from adjacent ones without performing any special treatment on the core element.

That is, in the process according to the present invention, each of core elements prepared by using commercially available silicon steel sheets and each of core elements made of ordinary magnetic steel sheets are alternately arranged one by one. The electrical insulations between any two adjacent core elements is completely realized on account of the electrical insulation provided on the commercially available silicon steel sheets.

Other objects and advantages of the invention will become apparent during the following discussion of the accompanying drawings.

DESCRIPTION OF THE PREFERRED EMBODIMENTS

Figure 1:
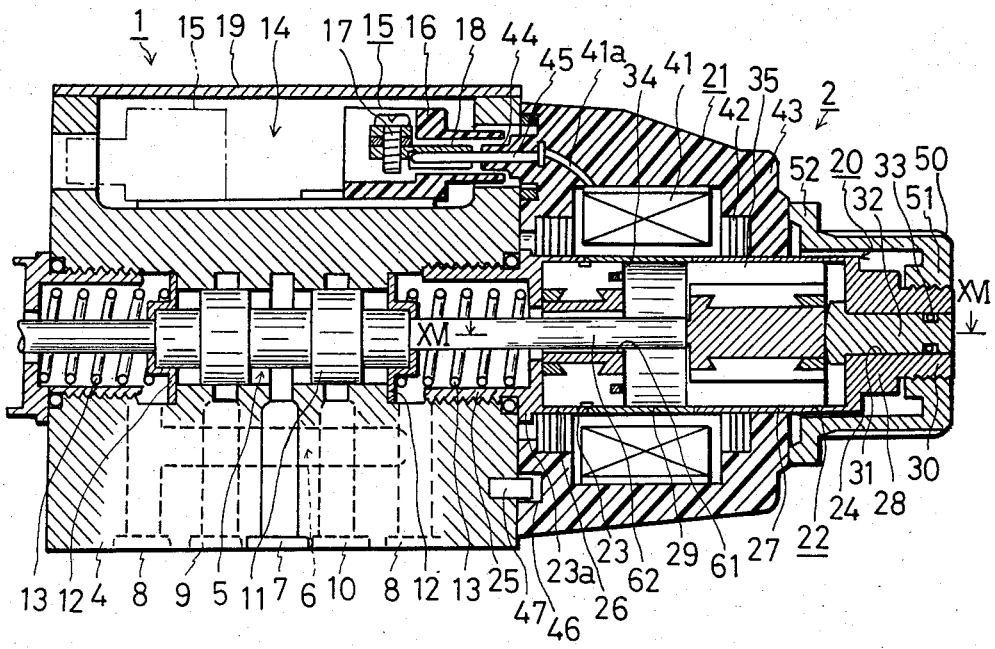
FIG. 1 is a longitudinal sectional view of an electromagnetic valve device.

Referring now to FIG. 1, a magnetic valve device comprises a valve device 1 and an electromagnet 2 for actuating the valve device. First, the valve device 1 will be described. A body 4 is interiorly formed with a space 5 for moving a spool forward and backward and an oil passage 6. The body 4 is further provided with a port 7 for connecting an oil pressure source (for example, a pump), a port 8 provided for connection to an oil tank, and ports 9 and 10 provided for connection to a driven device, for example, a hydraulic cylinder. These ports 7, 8, 9 and 10 are all in communication with the space 5. The port 8 is besides in communication with the oil passage 6. In the space 5 for moving the spool forward and backward there is provided a known spool 11 which is movable in a lateral direction as viewed in FIG. 1. Spring seats 12 are mounted on both left and right ends, respectively, of the spool 11. A spool return spring 13 is interposed between these springs 12 and a connector of each electromagnet which will be described later. These spool return springs 13 are provided to position the spool 11 at a neutral position as shown in FIG. 1, and compression springs are used therefor. The valve body 4 is partly formed with a recess 14 which is provided with connecting terminal boxes 15, 15. Each of the connecting terminal boxes 15 is so designed that a case 16 formed of an insulating material is interiorly provided with a connecting terminal 17 and a socket 18 connected thereto. An electric wire for supplying power adapted to actuate the electromagnet is connected to the connecting terminal 17. The recess 14 with the terminal box 15 accommodated therein is closed by a cover 19. It is noted that the cover 19 is provided with a known through-hole, through which the electric wire is pulled out.

Next, the electromagnet 2 will be described. This electromagnet includes a driving member 20 for having the valve device 1 effect mechanical operation and a magnetizing member 21 adapted to exert the magnetic force upon the driving member. The driving member 20 has a hollow container 22. This container 22 comprises a connecting member 23 and an accommodating member 24. First, the connecting member 23 has a connecting portion 25, which is threadedly mounted in a threaded hole bored in the body 4. The connecting member 23 further has a cylindrical portion 26 which provides a connection with the accommodating member 24. The connecting member 23 is further provided with a flange 23*a*. This flange 23*a* comes into abutment with the end of the body 4 to thereby provide a positive connection between the body 4 and connecting member 23. While the aforesaid connecting member 23 is generally formed of a magnetic material such as iron, it will be noted that non-magnetic metal can be used to form the connecting member 23. The accommodating member 24 comprises an intermediate cylinder 29 and a cylindrical member 27 for guiding the forward and backward movement of the movable core, and an end member 28 formed integral with the member 27. While the cylindrical member 27 and end member 28 are formed of a magnetic material, it will be noted that they can be formed of a non-magnetic material. One end of the cylindrical member 27 and one end of the intermediate cylinder 29 are secured together over the entire circumference thoroughly by welding means. This intermediate cylinder 29 is positioned internally of the later-described coil and externally of the space where the movable core is moved forward and backward. Accordingly, the intermediate cylinder 29 is formed of a non-magnetic material so that the magnetic flux, which should pass through the later-described movable core and fixed core, may not pass through this intermediate cylinder 29. The other end of the intermediate cylinder 29 is secured, by welding, to the end of the cylindrical portion 26 in the connecting member 23 over the entire circumference thoroughly. As a consequence, the interior of the hollow container 22 is closed. The aforesaid end member 28 is formed with a connecting portion 30 in the form of external threads. The end member 28 is further formed with a through-hole 31, which is provided with a manually-operated push pin 32 movably leftwards in FIG. 1. An oil leak between the through-hole 31 and push pin 32 is prevented by means of an O-ring. Interiorly of the hollow container 22 there is fixedly provided a fixed core 34 at a position in the vicinity of the connecting member 23, and a movable core 35 is provided movably forward and backward in a lateral direction in FIG. 1. The construction of the fixed core 34 and movable core 35 will be described later.

Figure 16:
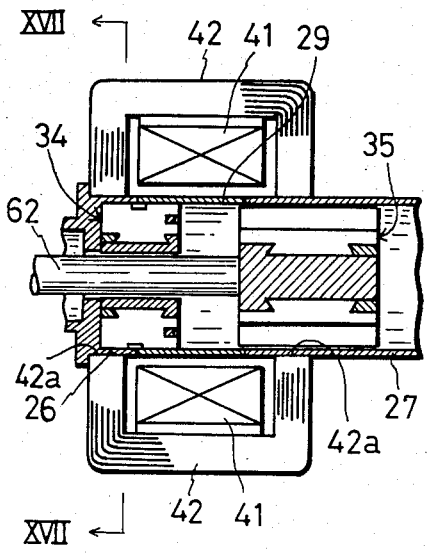
FIG. 16 is a sectional view taken on line XVI—XVI of FIG. 1 showing the relation between the coil, yoke, fixed core and movable core.
Figure 17:
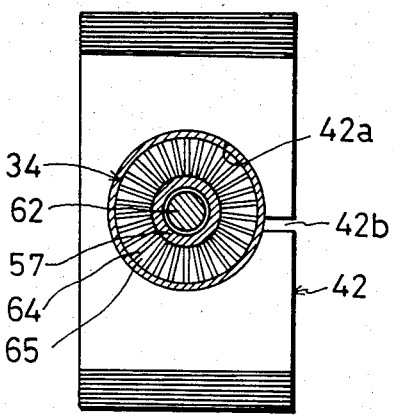
FIG. 17 is a sectional view taken on line XVII—XVII of FIG. 16.

Next, the magnetizing member 21 provided around the driving member 20 will be described. This magnetizing member 21 comprises a cylindrical coil 41 encircling the circumference of the hollow container 22 and a yoke 42 for exerting the magnetic flux generated in the coil 41 upon the fixed core 34 and movable core 35. The yoke 42 is constructed by winding round a thin steel sheet for a core as shown in FIG. 16. The thus constructed yoke 42 is partly formed with through-holes 42*a* and 42*a*. The hollow container 22 is inserted into these through-holes 42*a* and 42*a*. The yoke 42 is formed with a slit 42*b* as shown in FIG. 17. This slit 42*b* impairs generation of eddy current turning round the through-holes 42*a*. The coil 41 and yoke 42 are fixedly accommodated within a case 43. It is noted that the case 43 shown in FIG. 1 is an example of a molded case formed by molding a synthetic resin material with the coil 41 and yoke 42 embedded. However, alternatively, as is well known, the case can be made in a way that it is formed of metal or synthetic resin material into a hollow configuration, into which a coil and yoke is inserted in the later-step. The case 43 is partly fixedly provided with a plug holder 44 by which holder a plug 45 is fixedly held. A lead wire 41a of the coil 41 is connected to the plug 45. The plug 45 is removably inserted into the socket 18. The case 43 is further partly formed with a recess 46, into which is fitted a pin 47 projected from the body 4 in the valve device. These recess 46 and pin 47 are provided to prevent rotation of the magnetizing member 21 round the driving member 20.

Next, a fixing device 50 for fixing the magnetizing member 21 will be described. This fixing device 50 is molded of a synthetic resin material into an annular configuration. The fixing device 50 comprises a threadedly fitting portion 51 adapted to threadedly fit into the connecting portion 30 and an annular pressing portion 52 adapted to push the end of the case 43 in the magnetizing member 21.

Figure 7:
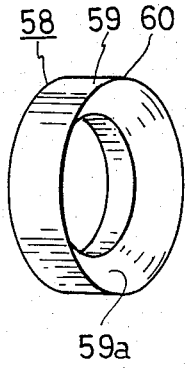
FIGS. 6 and 7 are respectively perspective views of a connecting means element.
Figure 8:
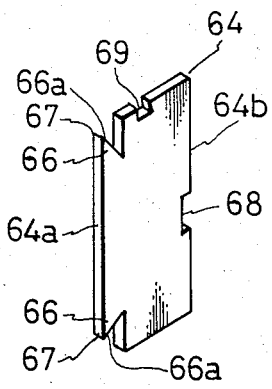
FIGS. 8 and 9 are respectively perspective views of a core element.
Figure 9:
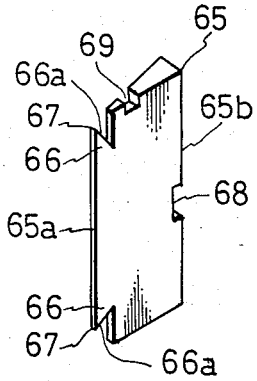

In the following, the aforesaid fixed core 34 will be described in detail with reference to FIGS. 2 to 9. The fixed core 34 comprises a centrally-located connecting means 55 and a main portion 56 of core disposed thereround. The connecting means 55 is constructed by connecting two elements 57 and 58. The connecting means 55 is formed by use, for example, as a material, of high strength material such as S10C or S45C. The element 57 comprises a cylindrical body 57*a* and an annular connecting portion 59 provided in the outer circumference of one end thereof. The other element 58 merely comprises an annular connecting portion 59. The connecting portions 59 of both the elements 57, 58 constitute a dovetail groove. Each of the connecting portions 59 terminates in an annular stop pawl 60. Each of the connecting portions 59 has its inner surface 59*a* which is formed into an inwardly-directed conical surface opposed to the outer circumferential surface of the body 57*a*. This inner surface 59*a* is also called a locking surface in the present specification. The element 57 is provided at its center portion with a through-hole 61, into which is inserted a push rod 62, which transmits movement of the movable core 35 to the spool 11, movably in a lateral direction in FIG. 1. The core main portion 56 is composed of plural sheets of core elements 64, 65 shown in FIGS. 8 and 9, respectively. The side shapes of these core elements 64, 65 are all the same. These core elements 64, 65 are alternately arranged as clearly shown in FIG. 2 and are disposed so that they are positioned radially round the connecting means 55. The core element 65 is formed of magnetic steel plate, for example. On the other hand, the core element 64 is formed of silicon steel plate so that eddy current is hard to generate in the main portion 56. The core element 65 is formed to be thicker towards a portion on the outer circumferential side, and to be thinner towards a portion on the inner circumferential side. As a consequence, the elements 64, 65 are successively superposed one upon another whereby the whole element are annually arranged round the connecting means 55. Both the elements 64, 65 can be formed of silicon steel plate. Alternatively, both the elements can be formed of magnetic steel plate, but it is suggested in this case that suitable surface treatment is applied thereto so as to increase the electric resistance of the surface. Where these elements are made of one kind of material, elements different in shape from one another as shown in FIGS. 8 and 9 need not be made but elements of a single kind will suffice which have a thickness so that they may be disposed radially when plural sheets thereof are closely arranged. Inner circumferential ends 64*a*, 65*a* of the core elements 64, 65, respectively, are provided at their one end and other end with engaging portions 66, 66 of the same shape. These engaging portions 66 are formed into the shape corresponding to that of the connecting portion 59 in the connecting means 55. The engaging portion 66 has an engaging surface 66*a* in abutment with the locking surface 59*a*. The engaging portion 66 terminates in an engaging pawl 67.

Figure 2:
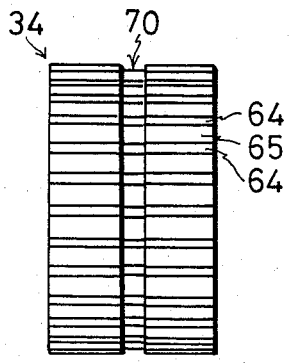
FIG. 2 is an enlarged side view of a fixed core.
Figure 3:
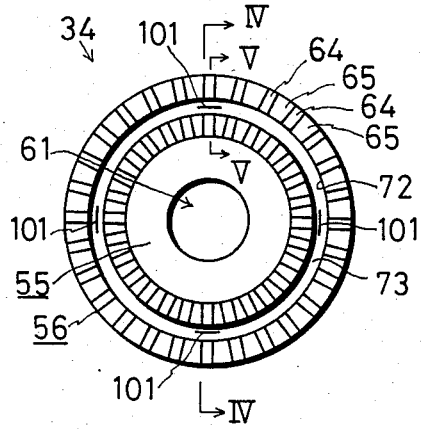
FIG. 3 is an enlarged front view of a fixed core.

On the other hand, the core elements 64, 65 are formed at their outer circumferential ends 64*b*, 65*b* with locking recesses 68, respectively. The recesses 68 of the core elements 64, 65 are continuous to each other to form a recessed groove 70 as shown in FIG. 2. The elements 64, 65 are provided with a recess 69 which receives therein a shading coil. These recesses 69 are also formed with a recessed groove 72 as shown in FIG. 3. A shading coil 73 is embedded into the recessed groove 72 as clearly shown in FIG. 5. The shading coil 73 is formed, for example, of a good conductive material such as copper. To form this shading coil, suitable means such as cutting or press punching may be used.

Figure 11:
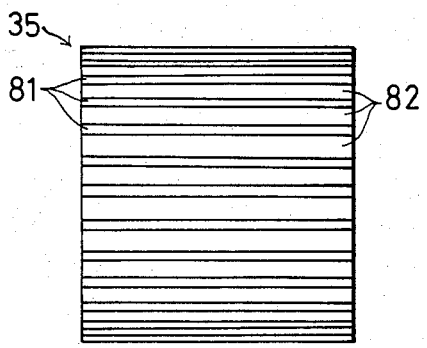
FIG. 11 is an enlarged side view of a movable core.
Figure 12:
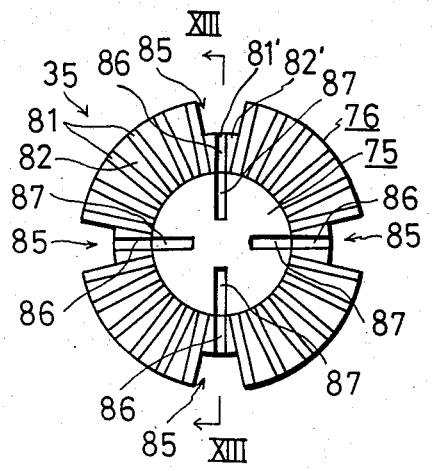
FIG. 12 is an enlarged front view of the movable core.
Figure 13:
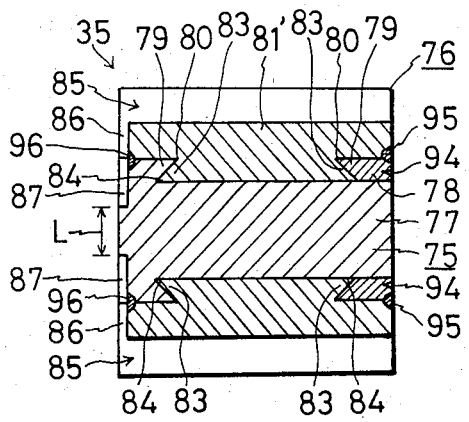
FIG. 13 is a sectional view taken on line XIII—XIII of FIG. 12.
Figure 18:
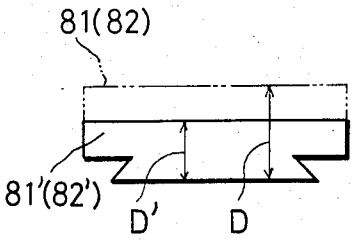
FIG. 18 is a view showing the side shape of a core element for forming an oil flowing groove.

Next, the movable core 35 will be described with reference to FIGS. 11 to 13. This movable core 35 is constructed in a manner equal to that used for the fixed core 34. That is, a connecting means 75 comprises two elements 77, 78, which have connecting portion 79 having a stop pawl 80. A main portion 76 for a core round the connecting means 75 comprises plural sheets of core elements 81 formed of silicon steel plate and plural sheets of core elements 82 formed of magnetic steel plate. These core elements 81, 82 are radially disposed round the connecting means 75. The core elements 81, 82 are provided at one end and other end in inner circumferential ends thereof with engaging portions 83 of the same shape having engaging pawls 84, respectively. These engaging portions 83 engage the connecting portion 79 of the connecting means 75. Next, the main portion 76 of the movable core 35 has an oil flowing groove 85 in the circumferential side thereof. This groove 85 is formed lengthwise in a longitudinal direction, i.e., in forward and backward direction of the movable core. At this groove 85, elements 81', 82' are used in which the radial dimension D' is made shorter than the radial dimension D of the elements 81, 82 as shown in FIG. 18. The main portion 76 is formed with an oil flowing groove 86 in the surface on the side opposed to the fixed core 34. This groove 86 is formed as clearly shown in FIG. 13 by reducing the longitudinal dimension of a part of the element 81', i.e., the axial dimension of the movable core 35. Further, the element 77 of the connecting means 75 is formed with an oil flowing groove 87 connected to the groove 86. The dimension L between the grooves 87, 87 positioned opposite each other is formed to be smaller than the diameter of the push rod 62. Accordingly, in the state wherein the movable core is attracted by the fixed core 34, a part of the groove 87 is communicated with the through-hole 61, through which oil may flow.

In the above-described construction, when power is supplied to the connecting terminal 17 through the electric wire led from the outside, the power is fed to the coil 41 through the socket 18 and plug 45. When the power is supplied and current flows into the coil 41, magnetic flux passes through a magnetic circuit comprising the yoke 42, the movable core 35 and the fixed core 34. As the result, the movable core 35 is attracted towards the fixed core 34 and moved in that direction. This movement of the movable core 35 is transmitted to the spool 11 through the push rod 62, and the spool 11 is moved leftwards in FIG. 1. As the result, the port 7 and port 9 are placed in communication and the port 10 and port 8 placed in communication. In the above-described electromagnetic valve device, the hollow container 22 is interiorly filled with oil which entered from the oil passage 6 through the through-hole 61. On the other hand, since the movable core 35 is formed with the oil flowing groove 85, in the event that the movable core 35 is moved laterally, oil may flow between the right side and left side of the movable core 35 passing through the groove 85. Accordingly, the presence of oil within the container 22 will not hamper the movement of the movable core 35.

Next, when the energization as described above is cut off, generation of magnetic flux caused by the coil 41 no longer exists. Therefore, the movable core 35 is not attracted by the fixed core 34. Then, the spool 11 is returned to its neutral position as shown in FIG. 1 by means of a biasing force of the spool return spring 13 provided on the left-hand of the spool 11 in FIG. 1. Also, the movable core 35 is returned to the position as shown in FIG. 1 by the movement of the spool 11 through the push rod 62. In the above-described case, even if the movable core 35 is in tightly close contact with the fixed core 34, movement of the movable core 35 from the fixed core 34 is effected smoothly. Because the movable core 35 is formed at its end with the oil flowing grooves 86, 87, through which the through-hole 61 and oil flowing groove 85 are communicated with each other, and therefore, movement of oil is effected smoothly.

Where the coil 41 is energized to actuate the movable core 35 as described above, even if current flowing into the coil 41 is AC, a loss of eddy current at the fixed core 34 and movable core 35 can be minimized. Accordingly, energy of said current can be used efficiently for operation of the movable core 35. The reasons are as follows: The core main portions 56, 76 of the fixed core 34 and movable core 35, respectively, are of the laminated construction as previously mentioned. Thus, eddy current is hard to generate thereat. On the other hand, the connecting means 55, 75 in the cores 34, 35 are of the solid construction, and therefore, there is a possibility of generating eddy current thereat. However, any of connecting means 55, 75 are used at the center portions of the cores 34, 35, respectively, and therefore, sectional areas thereof are extremely small as compared with those of the cores 34, 35. For example, if the radius of the connecting means is $\frac{1}{3}$ of the radius of the core, the sectional area is 1/9, and if the radius is 1/5, the sectional area is 1/25. If the sectional area is small as described above, eddy current generated thereat is also small. For these reasons, the loss of eddy current at the cores 34, 35 is small.

In the case of operation as described above, when a load bearing surface of the movable core 35, that is, a surface opposed to the rod 62 impinges upon the rod 62, the reaction of shock resulting therefrom is applied from the rod 62 to the connecting means 75 in a direction of axis thereof (in a lateral direction in FIG. 1). This reaction is similarly applied to all the elements 81, 82, 81' and 82' through the connecting portion 79 and connecting portion 83 connected thereto. Thus, even if such an impingement as described above is repeatedly carried out, deviation between many elements 81, 82, 81' and 82' rarely occurs.

Furthermore, in the case of the above-described operation, the push rod 62 is repeatedly moved forward and backward within the through-hole 61 provided in the center of the fixed core 34. However, since the through-hole 61 is formed in the connecting means 55, none of the core elements 64, 65 comes into touch with the rod 62 which moves forward and backward. Therefore, even if the device is made to effect operation for a long period of time, no deviation between a number of core elements 64, 65 occurs.

Figure 6:
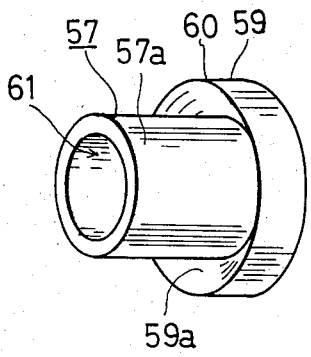
Figure 10A:
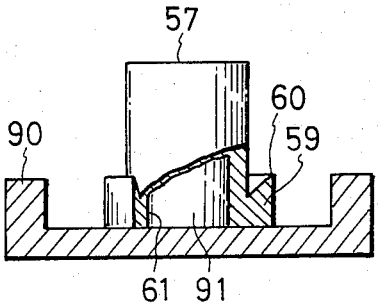
FIG. 10 is a view showing the assembling process of the fixed core.
Figure 10B:
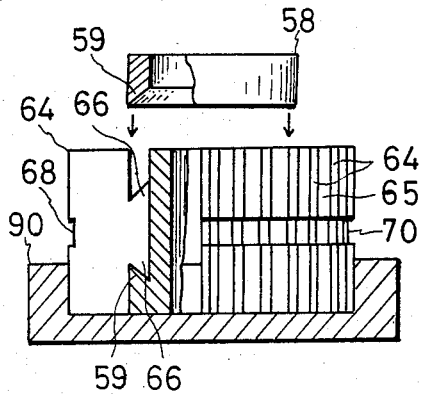

Next, the procedure of manufacturing the driving member 20 in the above-described electromagnet will be described. First, the manufacturing of the fixed core 34 in the driving member 20 will be performed in the following. First, one connecting means element 57 as shown in FIG. 6, one connecting means element 58 as shown in FIG. 7, a number of elements 64 and elements 65 shown in FIGS. 8 and 9, respectively, are prepared. An element 57 is secured to a jig 90 prepared in advance by suitable means as shown in FIG. 10 (A). For example, a locating rod 91 secured to the jig 90 is inserted into a through-hole 61. Thereafter, a number of elements 64, 65 are radially disposed round the element 57 in order one by one or more in number at a time so as to assume the order of arrangement as shown in FIG. 3. This work is accomplished by placing the inner circumferential ends **64*a*, 65*a* of the elements 64, 65 along the outer circumferential surface of the body 57*a* and placing the engaging surface 66*a* of the engaging portion 66 in abutment with the locking surface 59*a* of the connecting portion 59. In this manner, a number of elements are disposed till sides of the adjoining core elements come into close contact with each other. After the arrangement has been completed as described above, then the element 58 is tightly fitted in the body 57*a* of the element 57 as shown in FIG. 10 (B). In this case, the engaging portion 66 is brought into engagement with the connecting portion 59 to place the engaging surface 66*a* in abutment with the locking surface 59*a***.

Figure 4:
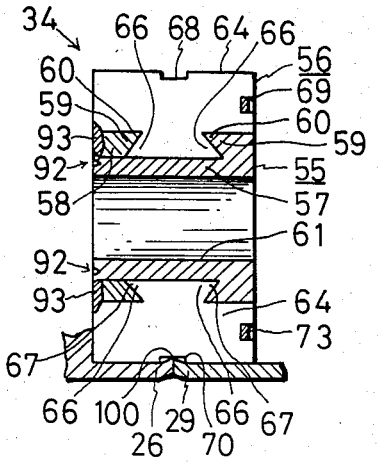
FIG. 4 is a sectional view taken on line IV—IV of FIG. 3.
Figure 5:
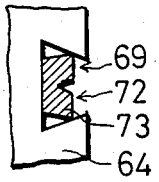
FIG. 5 is a fragmentary sectional view taken on line V—V of FIG. 3 showing a fixed construction of a shading coil relative to a main portion of the core.

Thereby the engaging pawl 67 of each element is stopped by the stop pawl 60 to prevent each element from moving away from the connecting means 55. Next, a point indicated at 92 is caulked to positively secure the element 58 to the element 57. Also, a point as indicated at 93 is welded to positively and integrally secure the elements 57, 58 and the latter to other elements. Thereafter, the outer circumferential surface of the main portion 56 is subjected to polishing (for example, centerless polishing) to make the diameter thereof have the size snugly fitted into the cylindrical portion 26 and intermediate cylinder 29 of the hollow container 22. Both ends (left and right ends in FIG. 4) of the fixed core 34 are cut and finished into flat surfaces. Posterior or prior to the aforesaid polishing and cutting treatments, the shading coil 73 is incorporated into the recessed groove 72. This work can be performed by fitting the coil 73 into the recessed groove 72 and thereafter deforming a point, which is indicated at 101 in FIG. 3, as shown in FIG. 5. Thereby, the coil 73 comes into abutment with the side wall of the recessed groove 72 and is secured thereto. The fixed core 34 is now completed.

Next, assembling of the movable core 35 will be carried out similarly to the case of the aforesaid fixed core 34. That is, the main portion 76 is assembled into the connecting means 75. Next, a point as indicated at 94 is caulked to secure the elements 77, 78 to each other. Thereafter, points indicated at 95, 96 are respectively welded to positively and integrally secure the elements 77, 78 and the latter to the elements 81, 82, 81', 82'. Then, the outer circumferential surface of the main portion 76 is subjected to polishing treatment. Thereby the movable core 35 is completed.

On the other hand, the connecting member 23 and accommodating member 24 in the hollow container 22 are respectively formed separately from the above-described work. Where the accommodating member 24 is formed, the cylindrical member 27 and intermediate cylinder 29 are pre-welded, and the inner circumferential surfaces thereof are subjected to polishing treatment to prevent forward and backward movement of the movable core 35 from being hampered.

Next, the fixed core 34, movable core 35, push pin 32 and the like are assembled into the hollow container 22 to complete the driving member 20. In this work, first, the fixed core 34 is fitted into the cylindrical portion 26 in the connecting member 23. On the other hand, the push pin 32 in inserted into the through-hole 31 in the accommodating member 24, and the movable core 35 is accommodated within the accommodating member 24. Thereafter, the end of the intermediate cylinder 29 in the accommodating member 24 is placed over the fixed core 34. The end of the cylindrical portion 26 and the end of the intermediate cylinder 29 butt each other and are welded over the whole circumference thereof. In case of this welding, in a portion where the end of the cylindrical portion 26 and the end of the intermediate cylinder 29 butt, the recessed groove 70 of the fixed core 34 is present at the rear thereof. Thus, where the aforesaid butted portion is heated and welded, heat for welding is hard to be scattered and lost thereabout from said portion (the butted portion is hard to be lowered in temperature). As the result, it is possible to carry out the welding of said butted portion easily and with good workability. Also, in case of this welding, gases expanded between both the butted ends and the recessed groove 70 flow out through small clearances left between the plural elements 64 and 65. By said welding, a crown portion 100 projected towards the interior of the recessed groove 70 as shown in FIG. 4 is formed in the aforesaid butted portion. Naturally, this crown portion 100 is formed over the whole circumference round the recessed groove 70. The crown portion 100 is entered into the recessed groove 70 as described above, and as a consequence, locking of the fixed core 34 to the hollow container 22 is positively achieved. By the above-described work, the cylindrical portion 26 and intermediate cylinder 29 are connected to each other to complete the hollow container 22 whose interior is sealed, and the fixed core 34 is secured to the container 22 to complete the driving member 20.

Next, the procedure for assembling the electromagnetic valve device which comprises the aforesaid valve device 1 and solenoid 2 will be described. First, the connecting portion 25 of the driving member 20 is threadedly mounted in the tapped hole of the valve body 4 to thereby connect the driving member 20 to the valve device 1. Next, the magnetizer 21 is placed over the outer circumference of the driving member 20. Next, the threadedly fitting portion 51 of the fixing device 50 is threadedly fitted into the connecting portion 30. This fixing device 50 is tightened till the pressing portion 52 urges the case 43 against the end of the body 4 in the valve device 1. Thereby the assembling work of the electromagnetic device is completed. An electromagnet similar to that positioned on the right-hand is connected also to the left-hand of the valve device 1 though a part thereof is shown in FIG. 1.

Figure 14:
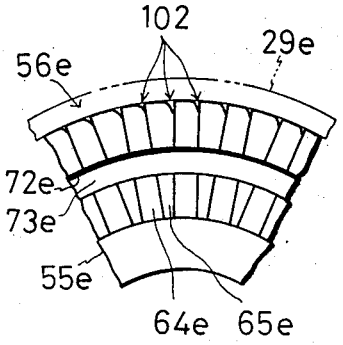
FIGS. 14 and 15 are respectively views showing examples which are different in partial construction of the fixed core.

Next, FIG. 14 shows an example which is partly different in construction of the fixed core. In FIG. 14, in the outer circumferential surface of a core main portion **56*e*, fine grooves 102 are formed between core elements 64*e* and 65*e*. Where the elements 64*e* and 65*e* are respectively manufactured by press punching, shoulders on one surface of the elements 64*e* and 65*e* are roundly deformed in the crushed form. The elements 64*e*, 65*e* having such a deformed portion are superposed one upon another to thereby form the aforesaid groove 102. This groove 102 is lengthy in an axial direction of the fixed core. By the provision of such a groove 102, where the cylindrical portion in the aforesaid connecting member and the intermediate cylinder in the accommodating member are welded, even if gases are generated from and between their butted portion and the recessed groove or air present therein is expanded, said gases or air may be escaped through the groove 102. Such a groove 102 is effective in the event that the plural elements 64*e* and 65*e*** are very closely superposed one upon another to rarely form a clearance, therebetween, through which the gases may escape during said welding.

It will be noted that parts, which are the same as or equal to those shown in the preceding figures in function, are indicated by the same reference numerals as those of preceding figures with an alphabet 'e' affixed thereto and like description was omitted. The same is true for the next figure and FIG. 19, in which alphabets 'f' and 'g' are likewise affixed to the numerals in these figures, and like description was omitted.

Figure 15:
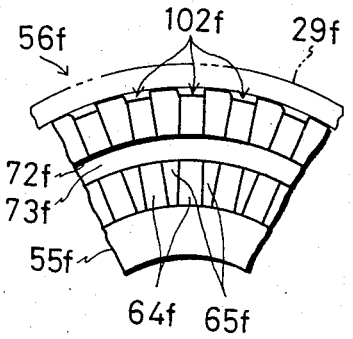

Next, FIG. 15 shows an example which is different in process of forming a groove **102*f*, wherein the radial dimension of an element 64*f* is made to be slightly smaller than that of the radial direction of an element 65*f* to form the groove 102*f* therein. Alternatively, the dimension of the element 65*f* can be made smaller than that of the element 64*f*** to form the groove.

Figure 19:
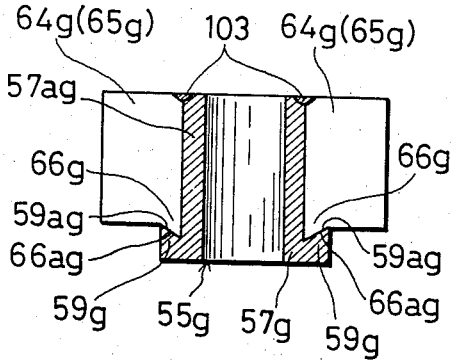
FIG. 19 is a view showing a modified example of a process of connecting a connecting means and core elements.
Figure 20:
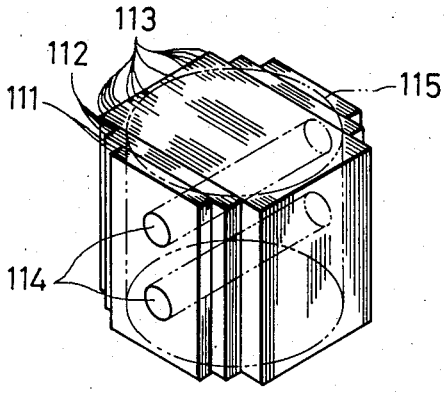
FIG. 20 is a view for explaining prior art means for forming a core.

Finally, FIG. 19 shows an example which is different in connecting means between a connecting body and core elements. A connecting means **55*g* merely comprises an element 57*g*. On the other hand, a core element 64*g* (65*g*) is provided in its inner circumferential end with an engaging end 66*g* only on one end. After a number of elements 64*g* (65*g*) have been arranged round the connecting means 55*g*, one end of a body 57*ag* and one end of the inner circumferential end in each element are welded at a point indicated at 103**.

As many apparently widely different embodiments of this invention may be made without departing from the spirit and scope thereof, it is to be understood that the invention is not limited to the specific embodiments thereof except as defined in the appended claims.

What is claimed is:

1. A process for manufacturing a magnetic core of a circular cylindrical external form used in a space inside a cylindrical coil, comprising the steps of:

(a) preparing an engaging means which comprises two elements, one element including a cylindrical body and a connecting portion formed on the outer circumferential surface at one end of said cylindrical body and provided with a conical locking surface opposed to said outer circumferential surface of said cylindrical body and directed toward one end of said cylindrical body, and the other element being made in a ring-like form suitable for placement on the outer circumferential surface at the other end of the cylindrical body and directed toward the other end of said cylindrical body, (b) preparing a plurality of core elements of a uniform thickness made of silicon steel sheets which are respectively provided at one edge portion thereof to be positioned close to the outer circumferential surface of said cylindrical body, with an engaging portion for insertion between the outer circumferential surface of said cylindrical body and the conical locking surface of the connecting portion in said one element, and with an engaging portion for insertion between the outer circumferential surface of said cylindrical body and a conical locking surface in said ring-like element, (c) preparing a plurality of core elements made of magnetic steel sheets which are respectively provided, at one edge portion thereof to be positioned close to the outer circumferential surface of said cylindrical body, with an engaging portion for insertion between the outer circumferential surface of said cylindrical body and the conical locking surface in said ring-like element, and made thinner at the edges thereof to be positioned close to the outer circumferential surface of the cylindrical body and thicker at the opposite edges thereof, (d) alternately arranging each of a plurality of said core elements made of silicon steel sheets and each of magnetic steel sheets radially one by one around said cylindrical body in direct contact with each other and simultaneously interposing one engaging portion on each of all the core elements between the outer circumferential surface of said cylindrical body and the conical locking surface of the connecting portion provided peripherally on said cylindrical body, and (e) interposing the other engaging portion of each of said core elements between the outer circumferential surface of said cylindrical body and the conical locking surface in said ring-like element by placing the ring-like element on the other end of said cylindrical body and simultaneously fixing said ring-like element on said cylindrical body.

2. A process according to claim 1 further including the step of securing the ends of said plurality of core elements to the connecting portion by the step of welding said ends of said plurality of core elements to a portion adjacent to one end of the body.

3. a process according to claim 1 wherein said step of preparing said connecting portion further includes said ring-like element to be connected to the other end of said body, said ring-like element having a connecting portion of the same shape as that of the connecting portion provided on said body, said step of preparing the plurality of core elements comprises preparing a plurality of core elements having an engaging portion of complementary shape as that of the connecting portion provided on said one end of said body, said step of arranging the plurality of core elements around the connecting means comprises arranging the core elements while placing the inner circumferential ends of the respective core elements along the outer circumferential surface of the body and placing the engaging surface of one engaging portion of the resepective core elements in abutment with the locking surface of the connecting portion provided on said body, and securing the plurality of core elements to the connecting means by the step of connecting said ring-like element to the other end of said body in the state wherein the locking surface of said ring-like element is brought into abutment with the engaging surface of the other engaging portion in each of said core elements.

4. A process according to claim 3 wherein said step of preparing the plurality of core elements comprises the step of preparing plural sheets of core elements of uniform thickness and plural sheets of core elements, which inner ends are thin in thickness and which increase in thickness towards the outer circumferential ends, and said step of arranging the plurality of core elements around said connecting means further includes the step of alternately arranging said core elements of different thickness so that sides of the adjoining core elements are placed in contact with each other.

5. A process according to claim 3 wherein said step of preparing the plurality of core elements comprises the step of preparing core elements, which inner circumferential ends are thin and which increase in thickness towards the outer circumferential ends thereof so that sides of the adjoining core elements come into contact with each other where the core elements are radially disposed in the state wherein the inner circumferential ends thereof are placed along the outer circumferential surface of said body, and said step of arranging the plurality of core elements around the connecting means further includes the step of bringing the sides of said adjoining core elements into contact with each other.

6. A process according to claim 3 wherein said step of preparing the connecting means comprises the step of preparing a cylindrical connecting means having a through-hole in the center thereof through which a push rod is inserted.

* * * * *